US008060970B2

(12) United States Patent
Solanki

(10) Patent No.: US 8,060,970 B2
(45) Date of Patent: Nov. 22, 2011

(54) TOOTHBRUSH

(75) Inventor: Sanjay Amratlal Solanki, Egham (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/722,430

(22) Filed: Mar. 11, 2010

(65) Prior Publication Data

US 2010/0162506 A1 Jul. 1, 2010

Related U.S. Application Data

(63) Continuation of application No. 11/479,767, filed on Jun. 30, 2006, now Pat. No. 7,707,676, which is a continuation of application No. 11/269,959, filed on Nov. 9, 2005, now abandoned, which is a continuation of application No. 11/071,024, filed on Mar. 2, 2005, now abandoned, which is a continuation of application No. 09/979,933, filed as application No. PCT/US00/15901 on Jun. 9, 2000, now Pat. No. 6,886,204.

(30) Foreign Application Priority Data

Jun. 14, 1999 (GB) ..... 9913717.6

(51) Int. Cl.
*A46B 9/04* (2006.01)
*A46B 3/22* (2006.01)

(52) U.S. Cl. ..... 15/110; 15/167.1; 15/207.2; 15/201

(58) Field of Classification Search ..... 15/167.1, 15/110, 207.2, 186, 187, 188
See application file for complete search history.

(56) References Cited

U.S. PATENT DOCUMENTS

| | | | |
|---|---|---|---|
| 301,644 | A | 7/1884 | Thompson |
| 585,358 | A | 6/1897 | Gould |
| 864,054 | A | 8/1907 | Abrams |
| 914,501 | A | 3/1909 | McEachern |
| 1,022,920 | A | 4/1912 | Anderson |
| 1,125,532 | A | 1/1915 | Himmel |
| 1,191,556 | A | 7/1916 | Blake |
| 1,268,544 | A | 12/1916 | Cates |
| 1,251,250 | A | 12/1917 | Libby |

(Continued)

FOREIGN PATENT DOCUMENTS

| | | |
|---|---|---|
| CH | 99738 | 6/1923 |

(Continued)

OTHER PUBLICATIONS

Plastics Extrusion Technology Handbook, Chapter Seve, Coextrusion and Dual-Extrusion Technology, pp. 168-189.

(Continued)

*Primary Examiner* — Shay L Karls
(74) *Attorney, Agent, or Firm* — George H. Leal

(57) ABSTRACT

A toothbrush includes a head having a proximal end and a distal end furthest from the proximal end. The head also includes a top face having a plurality of bristle tufts disposed therein, a back face opposed to the top face, and a tip. An elastomeric support element covers a portion of the back face, and the tip is uncovered by the elastomeric support element. A first plurality of elastomeric elements is integrally formed with the elastomeric support element. Each of the first plurality of elastomeric elements extends individually from the elastomeric support element and terminates in a free end.

25 Claims, 2 Drawing Sheets

U.S. PATENT DOCUMENTS

| | | | | |
|---|---|---|---|---|
| 1,456,535 | A | | 5/1923 | Cartwright |
| 1,466,723 | A | | 9/1923 | Izawa |
| 1,526,267 | A | | 9/1924 | Dessau |
| 1,588,785 | A | | 6/1926 | Van Sant |
| 1,598,224 | A | | 8/1926 | Van Sant |
| D75,971 | S | | 8/1928 | Faubert et al. |
| 1,704,564 | A | | 3/1929 | Friedland |
| 1,705,109 | A | | 3/1929 | Essbach |
| 1,764,130 | A | | 6/1930 | Vardeman |
| 1,796,893 | A | | 3/1931 | McVeigh |
| 1,797,946 | A | | 3/1931 | Eichel |
| 1,817,585 | A | | 8/1931 | Samuel |
| 1,833,555 | A | | 11/1931 | Bell et al. |
| 1,861,347 | A | | 5/1932 | Johnson |
| 1,872,832 | A | | 8/1932 | Silverberg |
| D88,805 | S | | 12/1932 | MacInnis |
| 1,892,068 | A | | 12/1932 | Metzler |
| 1,910,414 | A | | 5/1933 | Varga |
| 1,924,152 | A | | 8/1933 | Coney et al. |
| 1,927,365 | A | | 9/1933 | Frolio |
| 1,928,328 | A | | 9/1933 | Carpentier |
| 1,963,389 | A | | 6/1934 | Vardeman |
| 2,083,217 | A | | 7/1934 | Brothers et al. |
| 1,993,662 | A | | 3/1935 | Green |
| 2,003,243 | A | | 5/1935 | Campbell et al. |
| D99,352 | S | | 4/1936 | Grapp |
| 2,042,239 | A | | 5/1936 | Planding |
| 2,155,473 | A | | 9/1936 | Coleman |
| 2,059,914 | A | | 11/1936 | Rosenberg |
| 2,079,728 | A | | 5/1937 | Amoid |
| 2,088,839 | A | | 8/1937 | Coney et al. |
| 2,117,174 | A | | 5/1938 | Jones |
| 2,122,619 | A | | 7/1938 | McMath |
| 2,129,082 | A | * | 9/1938 | Byrer ..... 601/139 |
| 2,139,245 | A | | 12/1938 | Ogden |
| 2,146,455 | A | | 2/1939 | Tepper |
| 2,154,352 | A | | 4/1939 | Peterson |
| 2,154,846 | A | | 4/1939 | Heymann et al. |
| 2,172,624 | A | | 9/1939 | Robert |
| 2,176,309 | A | | 10/1939 | Love et al. |
| 2,189,175 | A | | 2/1940 | Jackson |
| 2,196,284 | A | | 4/1940 | Ackerman |
| 2,206,726 | A | | 7/1940 | Lasater |
| 122,815 | A | | 10/1940 | Crosby |
| 2,218,072 | A | | 10/1940 | Runnals |
| 2,219,753 | A | | 10/1940 | Seguin |
| 2,225,331 | A | | 12/1940 | Campbell |
| 2,233,936 | A | | 3/1941 | Campbell |
| 2,244,699 | A | | 6/1941 | Hosey |
| 2,253,910 | A | | 6/1941 | Luenz |
| 2,253,210 | A | | 8/1941 | Psiharis |
| 2,266,195 | A | | 12/1941 | Hallock |
| 2,364,205 | A | | 12/1944 | Fuller |
| 2,418,485 | A | | 4/1947 | Shipley |
| 2,438,268 | A | | 3/1948 | Bressler |
| 2,443,297 | A | | 6/1948 | Bressler |
| 2,443,461 | A | | 6/1948 | Kempster |
| 2,476,201 | A | | 7/1949 | Ligoure |
| 162,941 | A | | 4/1951 | Ehman |
| 2,583,750 | A | | 1/1952 | Runnals |
| 2,631,320 | A | | 3/1953 | Bressler |
| 2,650,383 | A | | 9/1953 | Bressler |
| 2,676,350 | A | | 4/1954 | Bressler |
| 2,685,703 | A | | 8/1954 | Dellenbach |
| 2,722,031 | A | | 11/1955 | Bressler |
| 2,807,820 | A | | 10/1957 | Dinhofer |
| 3,007,441 | A | | 11/1961 | Eyer |
| 3,050,072 | A | | 8/1962 | Diener |
| 3,103,680 | A | | 9/1963 | Krichmar |
| 3,129,449 | A | | 4/1964 | Cyzer |
| 3,152,349 | A | | 10/1964 | Brennesholtz |
| 3,188,672 | A | | 6/1965 | Gary |
| D201,867 | S | | 8/1965 | Newman |
| 3,258,805 | A | | 7/1966 | Rossnan |
| 3,337,893 | A | | 8/1967 | Fine et al. |
| 3,398,421 | A | | 8/1968 | Rashbaum |
| 213,669 | A | | 4/1969 | Miller |
| 3,553,759 | A | | 1/1971 | Kramer et al. |
| D239,221 | S | | 3/1976 | Wasserman |
| D248,696 | S | | 8/1978 | Greenberg |
| 4,128,910 | A | | 12/1978 | Nakata et al. |
| 4,263,691 | A | | 4/1981 | Pakarnseree |
| 4,277,862 | A | | 7/1981 | Weideman |
| 4,288,883 | A | * | 9/1981 | Dolinsky ..... 15/110 |
| 4,299,208 | A | | 11/1981 | Blanc |
| 4,364,142 | A | | 12/1982 | Pangle |
| 4,472,853 | A | | 9/1984 | Rauch |
| 4,480,351 | A | | 11/1984 | Koffler |
| 4,488,328 | A | | 12/1984 | Hyman |
| 4,543,679 | A | | 10/1985 | Rosofsky et al. |
| 4,628,564 | A | | 12/1986 | Youssef |
| 4,646,381 | A | | 3/1987 | Weihrauch |
| 4,691,405 | A | | 9/1987 | Reed |
| 4,694,844 | A | | 9/1987 | Berl et al. |
| 4,712,267 | A | | 12/1987 | Cheng |
| 4,827,551 | A | | 5/1989 | Maser et al. |
| 4,833,194 | A | | 5/1989 | Kuan et al. |
| 4,847,936 | A | | 7/1989 | Moglianesi et al. |
| 4,864,676 | A | | 9/1989 | Schaiper |
| 5,005,246 | A | | 4/1991 | Yen-Hui |
| 5,027,796 | A | | 7/1991 | Linzey |
| 5,040,260 | A | | 8/1991 | Michaels |
| 5,046,213 | A | | 9/1991 | Curtis et al. |
| 5,114,214 | A | | 5/1992 | Barman |
| 5,121,520 | A | | 6/1992 | Brice |
| 5,230,118 | A | | 7/1993 | Chamma |
| 5,242,235 | A | | 9/1993 | Li |
| 5,273,425 | A | | 12/1993 | Hoagland |
| 5,274,870 | A | | 1/1994 | Stollman |
| 5,355,546 | A | | 10/1994 | Scheier et al. |
| 5,373,602 | A | | 12/1994 | Bang |
| 5,483,722 | A | | 1/1996 | Scheier et al. |
| 5,511,275 | A | | 4/1996 | Volpenhein et al. |
| 5,533,227 | A | | 7/1996 | Ito et al. |
| 5,535,474 | A | | 7/1996 | Salazar |
| 5,604,951 | A | | 2/1997 | Shipp |
| 5,628,082 | A | | 5/1997 | Moskovich |
| 5,651,158 | A | | 7/1997 | Halm |
| 390,706 | A | | 2/1998 | Hohlbein et al. |
| 5,735,011 | A | | 4/1998 | Asher |
| 5,735,864 | A | | 4/1998 | Heisinger, Jr. |
| 5,758,380 | A | | 6/1998 | Vrignaud |
| 5,758,383 | A | | 6/1998 | Hohlbein |
| 5,774,923 | A | | 7/1998 | Halm |
| 5,802,656 | A | * | 9/1998 | Dawson et al. ..... 15/110 |
| 5,810,856 | A | | 9/1998 | Tveras |
| 5,813,079 | A | | 9/1998 | Halm |
| 399,349 | A | | 10/1998 | Barth |
| 5,836,033 | A | | 11/1998 | Berge |
| 5,839,149 | A | | 11/1998 | Scheier et al. |
| 402,116 | A | | 12/1998 | Magloff et al. |
| 403,510 | A | | 1/1999 | Menke et al. |
| 404,205 | A | | 1/1999 | Hohlbein |
| D404,206 | S | | 1/1999 | Hohlbein |
| D407,221 | S | | 3/1999 | Van Gelder |
| D407,222 | S | | 3/1999 | Van Gelder |
| D407,223 | S | | 3/1999 | Van Gelder |
| 5,896,614 | A | | 4/1999 | Flewitt |
| 5,920,941 | A | | 7/1999 | Iannotta |
| 5,930,860 | A | | 8/1999 | Shipp |
| 5,946,758 | A | | 9/1999 | Hohlbein et al. |
| 5,946,759 | A | | 9/1999 | Cann |
| 5,970,564 | A | | 10/1999 | Inns et al. |
| 5,984,935 | A | | 11/1999 | Welt et al. |
| 5,987,688 | A | | 11/1999 | Roberts et al. |
| 5,991,958 | A | | 11/1999 | Hohlbein |
| D420,515 | S | | 2/2000 | Van Gelder |
| D421,844 | S | | 3/2000 | Stark et al. |
| 6,032,315 | A | | 3/2000 | Liebel |
| D423,787 | S | | 5/2000 | Musciano |
| 6,067,684 | A | | 5/2000 | Kweon |
| 6,073,299 | A | | 6/2000 | Hohlbein |
| D428,702 | S | | 8/2000 | Van Gelder |
| 6,098,233 | A | | 8/2000 | Chen |
| 6,105,191 | A | | 8/2000 | Chen et al. |
| 6,115,870 | A | | 9/2000 | Solanki et al. |
| 6,119,296 | A | | 9/2000 | Noe et al. |

| | | | |
|---|---|---|---|
| 6,151,745 | A | 11/2000 | Roberts et al. |
| 6,178,582 | B1 | 1/2001 | Halm |
| 6,185,779 | B1 | 2/2001 | Kramer |
| 6,219,874 | B1 | 4/2001 | van Gelder et al. |
| 6,254,390 | B1 | 7/2001 | Wagner |
| 6,260,227 | B1 | 7/2001 | Fulop et al. |
| 6,276,021 | B1 | 8/2001 | Hohlbein |
| 6,311,358 | B1 | 11/2001 | Soetewey et al. |
| 6,314,606 | B1 | 11/2001 | Hohlbein |
| 6,322,573 | B1 | 11/2001 | Murayama |
| 6,345,405 | B1 | 2/2002 | Brackin |
| 6,352,545 | B1 | 3/2002 | Wagner |
| D456,139 | S | 4/2002 | Hohlbein |
| 6,374,448 | B2 | 4/2002 | Seifert |
| D459,087 | S | 6/2002 | Pfleger |
| 6,408,476 | B1 | 6/2002 | Cann |
| D461,959 | S | 8/2002 | Chan et al. |
| D463,131 | S | 9/2002 | Winter et al. |
| 6,442,786 | B2 | 9/2002 | Halm et al. |
| 6,442,787 | B2 | 9/2002 | Hohlbein |
| 6,446,295 | B1 | 9/2002 | Calabrese |
| 6,463,618 | B1 | 10/2002 | Zimmer |
| 6,463,619 | B2 | 10/2002 | Gavney, Jr. |
| 6,505,373 | B2 | 1/2003 | van Gelder et al. |
| 6,513,182 | B1 | 2/2003 | Calebrese et al. |
| 6,571,417 | B1 | 6/2003 | Gavney, Jr. et al. |
| D477,465 | S | 7/2003 | Reilly et al. |
| 6,599,048 | B2 | 7/2003 | Kuo |
| D478,211 | S | 8/2003 | Ping |
| D482,199 | S | 11/2003 | De Salvo |
| 6,658,688 | B2 | 12/2003 | Gavney, Jr. et al. |
| D486,649 | S | 2/2004 | Sprosta et al. |
| 6,708,364 | B1 | 3/2004 | Huber |
| 6,729,789 | B2 | 5/2004 | Gordon |
| 6,807,703 | B2 | 10/2004 | van Gelder et al. |
| 6,817,054 | B2 | 11/2004 | Moskovich et al. |
| 6,820,300 | B2 | 11/2004 | Gavney, Jr. |
| 6,859,969 | B2 | 3/2005 | Gavney, Jr. et al. |
| D503,538 | S | 4/2005 | Desalvo |
| 6,886,207 | B1 | 5/2005 | Solanki |
| 6,996,870 | B2 | 2/2006 | Hohlbein |
| D517,812 | S | 3/2006 | Hohlbein et al. |
| 7,024,720 | B2 | 4/2006 | Moskovich et al. |
| D531,809 | S | 11/2006 | Li |
| 7,143,462 | B2 | 12/2006 | Hohlbein |
| 7,322,067 | B2 | 1/2008 | Hohlbein |
| 7,707,676 | B2 | 5/2010 | Solanki |
| 7,950,100 | B2 | 5/2011 | Hohlbein |
| 2001/0014991 | A1 | 8/2001 | Halm et al. |
| 2002/0017003 | A1 | 2/2002 | Kramer et al. |
| 2002/0084550 | A1 | 7/2002 | Roberts et al. |
| 2002/0124337 | A1 | 9/2002 | Calabrese et al. |
| 2002/0138928 | A1 | 10/2002 | Calabrese |
| 2003/0009837 | A1 | 1/2003 | Cann |
| 2003/0033680 | A1 | 2/2003 | Davies et al. |
| 2003/0033682 | A1 | 2/2003 | Calebrese et al. |
| 2003/0077107 | A1 | 4/2003 | Kuo |
| 2003/0115699 | A1 | 6/2003 | Wagstaff |
| 2003/0116884 | A1 | 6/2003 | Wagstaff |
| 2003/0140440 | A1 | 7/2003 | Gavney, Jr. |
| 2003/0196283 | A1 | 10/2003 | Eliav et al. |
| 2003/0229959 | A1 | 12/2003 | Gavney, Jr. et al. |
| 2004/0006837 | A1 | 1/2004 | Cann |
| 2004/0010869 | A1 | 1/2004 | Fattori et al. |
| 2004/0025275 | A1 | 2/2004 | Moskovich et al. |
| 2004/0060132 | A1 | 4/2004 | Gatzemeyer et al. |
| 2004/0060133 | A1 | 4/2004 | Eliav |
| 2004/0060137 | A1 | 4/2004 | Eliav |
| 2004/0087882 | A1 | 5/2004 | Roberts et al. |
| 2004/0134007 | A1 | 7/2004 | Davies |
| 2004/0168271 | A1 | 9/2004 | McDougall |
| 2004/0221409 | A1 | 11/2004 | Gavney, Jr. |
| 2004/0231076 | A1 | 11/2004 | Gavney, Jr. |
| 2004/0231082 | A1 | 11/2004 | Gavney, Jr. |
| 2004/0237236 | A1 | 12/2004 | Gavney, Jr. |
| 2004/0255416 | A1 | 12/2004 | Hohlbein |
| 2005/0000049 | A1 | 1/2005 | Hohlbein |
| 2005/0015901 | A1 | 1/2005 | Gavney, Jr. |
| 2005/0086753 | A1 | 4/2005 | Roberts et al. |
| 2005/0166341 | A1 | 8/2005 | Solanki |
| 2006/0059642 | A1 | 3/2006 | Solanki |
| 2006/0064833 | A1 | 3/2006 | Jacobs |
| 2006/0085931 | A1 | 4/2006 | Roberts et al. |
| 2006/0130257 | A1 | 6/2006 | Cann |
| 2006/0242778 | A1 | 11/2006 | Solanki |
| 2006/0288510 | A1 | 12/2006 | Georgi et al. |
| 2007/0013484 | A1 | 1/2007 | Roberts et al. |

FOREIGN PATENT DOCUMENTS

| | | | | |
|---|---|---|---|---|
| CH | 460 705 | | | 10/1968 |
| CN | ZL99225704 | | | 2/1999 |
| CN | 99225704 | | | 11/1999 |
| DE | 2402785 | | | 3/1979 |
| DE | 29 30 459 | | | 2/1981 |
| DE | 31 14 507 | A1 | | 3/1983 |
| DE | 36 28 722 | A1 | | 2/1988 |
| DE | 3737223 | | | 5/1989 |
| DE | 9318148 | | | 5/1994 |
| DE | 9400231 | | | 5/1994 |
| DE | 9400926 | | | 5/1994 |
| DE | 698 02 741 | T2 | | 10/1998 |
| EP | O 165 546 | A3 | | 12/1985 |
| EP | 360766 | A1 | * | 3/1990 |
| EP | O 360 766 | A1 | | 3/1990 |
| EP | 0 577 656 | | | 1/1994 |
| EP | 1 034 721 | | | 9/2000 |
| EP | 1 080 664 | | | 3/2001 |
| EP | 1 308 108 | | | 5/2003 |
| EP | 1 350 442 | | | 8/2003 |
| EP | 1 187 541 | | | 8/2004 |
| FR | 442832 | | | 9/1912 |
| FR | 920 155 | | | 3/1947 |
| FR | 2 196 782 | | | 3/1974 |
| FR | 2 594 307 | A1 | | 4/1987 |
| FR | 2 773 961 | | | 7/1999 |
| GB | 17643 | | | 4/1912 |
| GB | 2 391 462 | | | 2/2004 |
| JP | 55-102835 | | | 1/1979 |
| JP | 1997-140456 | | | 3/1997 |
| JP | 2000-157338 | | | 6/2000 |
| JP | 2000-300345 | | | 10/2000 |
| JP | 2000-300347 | | | 10/2000 |
| JP | 2000300342 | A | * | 10/2000 |
| JP | 2000-308522 | | | 11/2000 |
| JP | 2000-308524 | | | 11/2000 |
| JP | 2001-314232 | | | 11/2001 |
| JP | 2002-142857 | | | 5/2002 |
| JP | 2002-223853 | | | 8/2002 |
| KR | 71 844 | | | 6/1971 |
| SU | 1708283 | | | 1/1992 |
| WO | WO 92/17092 | A1 | | 10/1992 |
| WO | WO 92/17093 | | | 10/1992 |
| WO | WO 93/14671 | | | 8/1993 |
| WO | WO 96/02165 | | | 2/1996 |
| WO | WO 96/15696 | A1 | | 5/1996 |
| WO | WO 96/23431 | | | 8/1996 |
| WO | WO 97/07707 | A1 | | 3/1997 |
| WO | WO 97/16995 | A1 | | 5/1997 |
| WO | WO 97/20484 | A1 | | 6/1997 |
| WO | WO 97/24048 | A1 | | 7/1997 |
| WO | WO 97/25900 | A1 | | 7/1997 |
| WO | WO 98/03097 | A1 | | 1/1998 |
| WO | WO 98/05239 | | | 2/1998 |
| WO | WO 98/05241 | | | 2/1998 |
| WO | WO 98/08458 | | | 3/1998 |
| WO | WO 98/18364 | A1 | | 5/1998 |
| WO | WO 98/22000 | A1 | | 5/1998 |
| WO | WO 99/37180 | | | 7/1999 |
| WO | WO 99/37181 | A1 | | 7/1999 |
| WO | WO 99/37182 | A1 | | 7/1999 |
| WO | WO 99/49754 | | | 10/1999 |
| WO | WO 00/15077 | A2 | | 3/2000 |
| WO | WO 00/53054 | | | 9/2000 |
| WO | WO 00/64307 | A1 | | 11/2000 |
| WO | WO 01/17433 | | | 3/2001 |
| WO | WO 01/45573 | | | 6/2001 |
| WO | WO 02/062174 | | | 8/2002 |

| | | |
|---|---|---|
| WO | WO 2004/014181 A1 | 2/2004 |
| WO | WO 2004/019801 | 3/2004 |
| WO | WO 2004/0261621 | 4/2004 |

OTHER PUBLICATIONS

Modern Plastics Encyclopedia, 67: 168-175, 1990.
Pebax 3533 SA 00, "Base Polymer for Structural Hot Melt Adhesives.".
Product Literature, Kraton Polymers, pp. 13-21.
Brochure, "Extrusion Lines for the Production of Monofilaments," pp. 2-12, 1989.
"Standard Terminology Relating to Plastics", American Society for Testing Materials, Designation: D883-00, pp. 1-15, Undated.
"Plastics Determination of flexural properties," British Standard, BS EN ISO 178:2003, Apr. 9, 2003.
"Standard Test Methods for Flexural Properties of Unreinforced and Reinforced Plastics and Electrical Insulating Materials [Metric]", American Society for Testing Materials, Designation: D 790M-93 Metric, pp. 1-9, Undated.
"Santroprene Rubber Physical Properties Guide, Tensile Properties, Dynamic Mechanical Properties, Tension and Compression Set, Fatigue Resistance," Advanced Elastomer Systems, pp. 2-19, Undated.
Office Action for U.S. Appl. No. 11/479,767 dated Dec. 7, 2006; Solanki; filed Jun. 30, 2006.
Office Action for U.S. Appl. No. 11/479,767 dated Aug. 8, 2008; Solanki; filed Jun.30, 2006.
Office Action for U.S. Appl. No. 11/479,767 dated May 8, 2007; Solanki; filed Jun. 30, 2006.
Office Action for U.S. Appl. No. 11/479,767 dated Dec. 13, 2007; Solanki; filed Jun. 30, 2006.
Office Action for U.S. Appl. No. 11/269,959 dated Jan. 10, 2006; Solanki; filed Nov. 9, 2005.
Office Action for U.S. Appl. No. 11/071,024 dated Jun. 9, 2005; Solanki; filed Mar. 20, 2005.
Office Action for U.S. Appl. No. 09/979,933 dated Aug. 13, 2003; Solanki; filed Jun. 9, 2000.
Office Action for U.S. Appl. No. 09/979,933 dated Mar. 12, 2004; Solanki; filed Jun. 9, 2000.
Office Action for U.S. Appl. No. 11/317,842 dated Jul. 28, 2006; Cann; filed Dec. 23, 2005.
Office Action for U.S. Appl. No. 11/317,842 dated Mar. 16, 2007; Cann; filed Dec. 23, 2005.
Office Action for U.S. Appl. No. 11/317,842 dated Dec. 27, 2007; Cann; filed Dec. 23, 2005.
Office Action for U.S. Appl. No. 11/317,842 dated Jul. 15, 2008; Cann; filed Dec. 23, 2005.
Office Action for U.S. Appl. No. 11/317,842 dated Jan. 26, 2009; Cann; filed Dec. 23, 2005.
Office Action for U.S. Appl. No. 11/317,842 dated Jul. 8, 2009; Cann; filed Dec. 23, 2005.
Office Action for U.S. Appl. No. 11/317,842 dated Oct. 13, 2009; Cann; filed Dec. 23, 2005.
Office Action for U.S. Appl. No. 11/317,842 dated Oct. 6, 2010; Cann; filed Dec. 23, 2005.
Office Action for U.S. Appl. No. 11/317,842 dated Mar. 25, 2011; Cann; filed Dec. 23, 2005.
Advisory Action for U.S. Appl. No. 08/730,286, dated Jun. 21, 1999; Masterman et al.; filed Oct. 30, 1996.
Office Action for U.S. Appl. No. 08/730,286, dated Apr. 12, 1999; Masterman et al.; filed Oct. 30, 1996.
Office Action for U.S. Appl. No. 08/730,286, dated Oct. 22, 1998; Masterman et al.; filed Oct. 30, 1996.
Office Action for U.S. Appl. No. 08/730,286, dated May 4, 1998; Masterman et al.; filed Oct. 30, 1996.
Office Action for U.S. Appl. No. 09/660,151, dated Aug. 31, 2001; Masterman et al.; filed Sep. 13, 2000.
Office Action for U.S. Appl. No. 09/660,151, dated Mar. 21, 2001; Masterman et al.; filed Sep. 13, 2000.
Office Action for U.S. Appl. No. 09/660,151, dated Feb. 7, 2001; Masterman et al.; filed Sep. 13, 2000.
Office Action for U.S. Appl. No. 10/991,911, dated Dec. 14, 2010; Masterman et al.; filed Nov. 18, 2004.
Office Action for U.S. Appl. No. 10/991,911, dated Sep. 11, 2008; Masterman et al.; filed Nov. 18, 2004.
Office Action for U.S. Appl. No. 10/991,911, dated Dec. 20, 2007; Masterman et al.; filed Nov. 18, 2004.
Office Action for U.S. Appl. No. 10/991,911, dated Jan. 17, 2007; Masterman et al.; filed Nov. 18, 2004.
Office Action for U.S. Appl. No. 10/991,911, dated Aug. 2, 2006; Masterman et al.; filed Nov. 18, 2004.
Examiner's Answer for U.S. Appl. No. 10/991,911, dated Jul. 10, 2006; Masterman et al.; filed Nov. 18, 2004.
Office Action for U.S. Appl. No. 10/991,911, dated Dec. 22, 2005; Masterman et al.; filed Nov. 18, 2004.
Office Action for U.S. Appl. No. 10/991,911, dated Jul. 12, 2005; Masterman et al.; filed Nov. 18, 2004.
Office Action for U.S. Appl. No. 10/991,911, dated Mar. 28, 2005; Masterman et al.; filed Nov. 18, 2004.
Office Action for U.S. Appl. No. 11/809,255, dated Jun. 27, 2008; Roberts et al.; filed May 31, 2007.
Office Action for U.S. Appl. No. 11/809,255, dated Dec. 26, 2007; Roberts et al.; filed May 31, 2007.
Examiner's Answer for U.S. Appl. No. 11/248,087, dated Oct. 1, 2008; Masterman et al.; filed Oct. 12, 2005.
Office Action for U.S. Appl. No. 11/248,087, dated Dec. 13, 2007; Masterman et al.; filed Oct. 12, 2005.
Office Action for U.S. Appl. No. 11/248,087, dated Feb. 9, 2007; Masterman et al.; filed Oct. 12, 2005.
Office Action for U.S. Appl. No. 11/248,087, dated Jun. 15, 2006; Masterman et al.; filed Oct. 12, 2005.
Office Action for U.S. Appl. No. 11/880,907 dated May 26, 2011; Chan; filed Jul. 25, 2007.
Office Action for U.S. Appl. No. 11/880,907 dated Jan. 20, 2011; Chan; filed Jul. 25, 2007.
Office Action for U.S. Appl. No. 11/880,907 dated Jul. 21, 2010; Chan; filed Jul. 25, 2007.
Office Action for U.S. Appl. No. 10/825,792, dated May 21, 2009; Chan et al.; filed Apr. 16, 2004.
Office Action for U.S. Appl. No. 10/825,792, dated Aug. 12, 2008; Chan et al.; filed Apr. 16, 2004.
Office Action for U.S. Appl. No. 10/825,792, dated Jul. 6, 2007; Chan et al.; filed Apr. 16, 2004.
Office Action for U.S. Appl. No. 10/825,792, dated Jan. 25, 2007; Chan et al.; filed Apr. 16, 2004.
Office Action for U.S. Appl. No. 10/825,792, dated May 12, 2006; Chan et al.; filed Apr. 16, 2004.

* cited by examiner

Fig. 4A
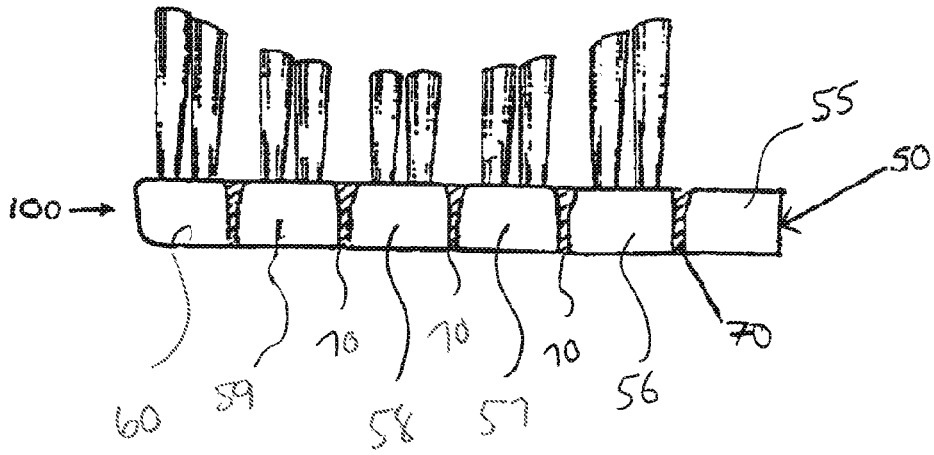
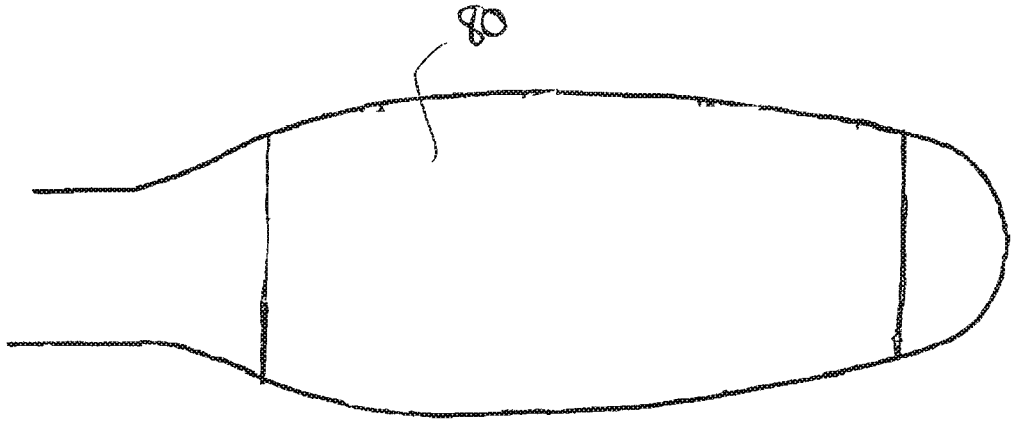
Fig. 4B

TOOTHBRUSH

CROSS REFERENCE TO RELATED APPLICATION

This application is a continuation of application Ser. No. 11/479,767, filed on Jun. 30, 2006 now U.S. Pat. No. 7,707,676, which is a Continuation of application Ser. No. 11/269,959, filed Nov. 9, 2005 now abandoned, which is a continuation of application Ser. No. 11/071,024, filed Mar. 2, 2005 now abandoned, which is a continuation of application Ser. No. 09/979,933 filed Jun. 9, 2001 now U.S. Pat. No. 6,886,207, the substances of which are incorporated herein by reference.

FIELD OF THE INVENTION

The present invention relates to toothbrushes and more particularly to toothbrushes with both bristles and gum massaging elements attached to the brush head.

BACKGROUND OF THE INVENTION

Toothbrushes generally comprise bristles, usually arranged in tufts of about 40 to 50, for the purpose of cleaning teeth by removing accumulated plaque and other debris. It has further been recognised gum health can be improved by gentle stimulation of the gums with massaging elements. There has therefore been a desire to have a toothbrush which provides for the cleaning ability of bristles, along with a massaging elements also located on the toothbrush head to stimulate the gums.

U.S. Pat. No. 4,277,862 discloses a toothbrush comprising an elongate massaging element along each side of the brush head. The toothbrush of U.S. Pat. No. 4,288,883 has a wider than conventional head with a central bristle portion flanked by arrays of massaging elements. U.S. Pat. No. 5,628,082 describes a toothbrush with transverse 'bristle' bars, the description revealing that the bristle bars can also be made of a rubber-like or thermoplastic material; the brush may also have a massaging tip. A toothbrush described in EP-A-360,766 has outer longitudinal rows of resilient massaging cylinders integrally formed with a backing which covers the back face of the toothbrush and its tip. WO-A-96/15696 describes a toothbrush with strips of a flexible and resilient material, which in some embodiments are arranged in transverse rows alternated with rows of bristles. WO-A-98/18364 discloses a toothbrush with a combination of bristles, soft cleansing pad and/or polishing fingers. FIG. 4 of that application shows a brush with longitudinal outer rows comprising both polishing fingers and bristle tufts.

Nevertheless, despite the foregoing, such brushes have not met with significant commercial success. One of the reasons may be that, although gum massaging elements can provide useful therapeutic benefits, it has been found by the present applicant that brush users dislike the feeling of significant amounts of rubber in the part of the brush head generally occupied by bristles. It has, however, now further been found that the impression of rubber on the brush head can be significantly alleviated, whilst retaining the benefits of massaging elements by interspersing massaging elements with bristle tufts along the brush periphery and by avoiding the use of massaging elements in the central portion of the brush head.

SUMMARY OF THE INVENTION

A toothbrush in accordance with the present invention comprises a head having a proximal end and a distal end furthest from the proximal end. The head further comprises a top face having a plurality of bristle tufts disposed therein, and a back face opposed to the top face, and a tip. The head further comprises an elastomeric support element covering a portion of the back face, wherein the tip is uncovered by the elastomeric support element. A first plurality of elastomeric elements is integrally formed with the elastomeric support element. Each of the first plurality of elastomeric elements extend individually from the elastomeric support element and terminating in a free end.

In another embodiment, a toothbrush comprises a handle and a head. The head includes ad a distal end furthest from the proximal end. The head further comprises a first segment continuous with the handle and comprising a plurality of bristle tufts; a second segment comprising a plurality of bristle tufts, the second segment being attached to the first segment; a third segment comprising a plurality of bristle tufts, the third segment being attached to the second segment; a first elastomeric connection between the first segment and the second segment; a second elastomeric connection between the second segment and the third segment; an elastomeric support element covering a portion of the back face; and a first plurality of elastomeric elements integrally formed with the elastomeric support element, each of the first plurality of elastomeric elements extending individually from the elastomeric support element and terminating in a free end.

DETAILED DESCRIPTION OF THE INVENTION

The toothbrush of the invention has an overall conventional construction, by which is meant that it comprises a generally elongated handle with a brush head attached to one end of the handle. The head can be detachably connected to the handle, for example to permit replacement of the head when bristles become worn. Herein the end of the handle to which the head is attached shall be referred to as the proximal end and the opposite end the distal end. The construction of the handle is not critical to the present invention. The handle should of course be comfortable to grip and allow easy manipulation of the brush so that the head can be moved around the various areas of the mouth. Preferably it will include elastomeric grip portions moulded to the rigid portion of the handle, as is now almost customary with toothbrush design. The handle can comprise a neck region at its proximal end, the neck being a portion of the handle which is generally of smaller cross-section than the rest of the handle and is usually devoid of grip elements.

The head too is of generally elongated shape with its long axis (a longitudinal axis) being aligned with that of the handle. The head is of generally flattened construction, having a bristle-bearing face with bristles and massaging elements attached thereto and a back face opposed to the bristle-bearing face. The head also has a transverse axis lying orthogonal to the longitudinal axis and generally parallel to the opposed faces. References to transverse or longitudinal herein refer to directions which are respectively parallel to these transverse and longitudinal axes, unless indicated otherwise. The head has a tip at the end remote from the handle. The tip may be co-planar with the rest of the head or, preferably, it can be angled upwards in relation to it (where upwards means in the direction of the bristles) in order to accentuate the effect of a molar cleaning tip without needing to provide longer bristles. If the tip is angled upwards then it is generally at an angle of from about 10° to about 20°, preferably from about 13° to about 18° to the rest of the head. Opposed longitudinal edges bound the bristle-bearing and back faces. The edges are coterminous with the handle and converge at the tip of the toothbrush head. The bristle bearing face has longitudinal perimeter portions adjacent the longitudinal edges. The longitudinal edges need not necessarily be straight or parallel to the longitudinal axis of the brush head. Typically they will be gently curved so that a plan view of the head is generally in the shape of an elongated oval.

The bulk of the head and handle are generally made of relatively non-compressible materials, preferably with a modulus of elasticity of at least about 500 MPa, more preferably at least about 1000 MPa, which are conventional in the manufacture of toothbrushes, especially plastics materials. Suitable plastics materials include, for example, polyamides and polypropylenes. Polypropylene is preferred. Suitable poly-propylenes include 'Polypropylene PM 1600' (marketed by Shell), having a modulus of elasticity (ISO 178) of 1500 MPa and Apryl 3400 MA1 from Elf Atochem.

The head and handle are generally made of relatively non-compressible materials, preferably with a modulus of elasticity of at least about 500 MPa, more preferably at least about 1000 MPa, which are conventional in the manufacture of toothbrushes, especially plastics materials. Suitable plastics materials include, for example, polyamides and polypropylenes. Polypropylene is preferred. Suitable polypropylenes include the material 'Polypropylene PM 1600' (marketed by Shell), having a modulus of elasticity (ISO 178) of 1500 MPa and Apryl 3400 MAI from Elf Atochem. Preferably, a foaming agent such as Hydrocerol HP20DP from Boehringer-Mannheim is mixed with the polypropylene at a level of from about 1% to about 3%, preferably from about 1.5% to about 2.5%, by weight of the polypropylene.

The foaming agent assists the flow of the polypropylene during moulding. The handle itself is generally rigid and may be of a shape which is conventional in the manufacture of toothbrushes. Optionally, the handle may comprise a neck portion which is more flexible than the rest of the handle.

The head comprises two or more segments, one of which may be coextensive with the handle. Preferably there are two, three or four segments, more preferably four.

Many more than this increases the manufacturing complexity and, in a toothbrush where bristle tufts are inserted only into the head segments, makes it difficult to achieve a sufficiently high tuft density on the brush head. The head segments can have any suitable spatial relationship to each other such as being in layers or arranged, for example, in quadrants of the brush head. Preferably, the segments are disposed in longitudinal sequence along the head so that a longitudinal line drawn from the handle end of the head to the free end of the head passes through the first head segment then the second head segment and so on. More especially, there is a first head segment which is connected to or continuous with the handle and one or more additional head segments arranged in longitudinal sequence towards the free end of the head. Preferably also, the segments are a monolayer so that any line drawn through the head perpendicular to its two opposed faces will generally pass through only one sort of material. In general, each head segment will be made of the same material which will preferably be the same material as the handle so that they can all be made in a single injection moulding step.

In the finished implement, all the head segments are connected by a connecting means. The connecting means can take any form which is suitable for the implement in its intended function. The connecting means can, for example, be adhesive, plastic links which are integral with or detachably connected to the head segments, or metal links. It is an essential feature of the invention, however, that at least one of the segments is joined to an adjacent segment or to the handle by a connecting means consisting essentially of an elastomer having a modulus of elasticity of less than 500 MPa, the elastomer being connected to the adjacent segments and/or to the handle so that the elastomer can be stretched to about 120% of its unstressed length without separation of the elastomer from the head segments.

By "consisting essentially of an elastomer" herein is meant that the elastomer is the sole mechanical link between the one segment and the adjacent segment or handle.

By sole mechanical link, what is meant is that there are no continuous, nonelastomeric links such as bridges or springs connecting the segments. The elastomer may, however, have other materials dispersed within it, such as flecks of metal or pigments which might be used, for example, to provide a distinctive appearance or modify the properties of the elastomer. These additional materials will generally make a negligible contribution to the mechanical connection between the segments and/or handle such that their removal would not materially alter the strength of connection. Connecting means between other segments can comprise an elastomer in addition to other mechanical connections such as plastic links, provided that at least one connecting means consists essentially of, or even only of an elastomer.

There can be from one to several connecting means which consist essentially of an elastomer. Preferably, in a multi-segmented head., the connecting means between each adjacent pair of segments consists essentially of an elastomer. In highly preferred embodiments herein the head has a top face and a bottom face and the connecting means extend transversely across the head and from the top face to the bottom face. For example, in a head comprising four segments, longitudinally sequenced along the head, with the first segment being co-extensive with the handle, there are three such connecting means. The bands of elastomer can vary in thickness, either from one band to the next or even across the width or along the depth of the band. Suitably, their thickness, measured along the longitudinal axis, is in the range from about 0.1 mm to about 10 mm, preferably from about 0.3 min to about 5 mm, more preferably from about 0.5 min to about 3 mm.

The bands of elastomer can be linear or non-linear. Preferably they are non-linear and take the form of chevrons or waves whose apex points towards the free end of the head.

The elastomer can be connected to the head segments and/or handle by any suitable means, such as by adhesive or by thermal fusion. The elastomer is preferably incorporated into the implement of the present invention by injection moulding, such that the elastomer becomes fused to the head segments and/or handle. It has surprisingly been found that strongest fusion of the elastomer to the segments and/or handle is obtained when a relatively high injection temperature is employed.

Preferably the elastomer is injected at a temperature in the range from about 245 degrees C. to about 270 degrees C., more preferably in the range from about 250 degrees C. to about 260 degrees C. The injection temperature is the temperature at which the elastomer enters the mould. In a typical injection moulding setup involving a screw-feed injection cylinder this may not be the same as the temperature of the elastomer in the cylinder. Preferably a lower temperature is employed in the cylinder, of around 210 degrees C. to about 220 degrees C., to reduce the possibility of burning or thermal degradation of the elastomer, heating to the final injection temperature being provided via a hot runner between the cylinder nozzle and the final injection point.

Other preferred conditions for the elastomer injection step include: a) An injection pressure in the range of from about 30 to about 80 MPa, preferably from about 40 to about 70 MPa, more preferably from about 50 to about 60 MPa and an elastomer injection time of less than one second, preferably less than about 0.8 s. Short injection times facilitate the elastomer reaching all the flexible joint areas at the desired temperature.

b) A holding pressure. after the elastomer has been fully injected, in the range of from about 5 to about 15 MPa, preferably from about 8 to about 12 MPa, held for between about 2 to about 5 seconds The head and handle are typically made by injection moulding. Bristles and massaging elements can be attached by art-known methods such as stapling and anchorless manufacturing technologies.

The bristle-bearing face of the head has both bristles and massaging elements attached thereto. The bristles and massaging elements have head ends, where they are attached to the head and free ends which provide the brushing/massaging surface of the brush. They are elongate between the head and free ends and have a long axis along the elongated direction. The bristles are generally arranged in tufts which project generally perpendicularly from the bristle-bearing face, although some tufts may lie at an angle of up to 40° from the perpendicular. The tufts typically contain from about 30 to about 100 or more bristles and generally have a uniform cross-section along their length in a plane parallel to the bristle-bearing face, such as would be provided by commercially available extruded bristle materials. Although the bristles are preferably straight, other configurations, such as crimped, may also be used. Some or all bristle tufts may also have flagged ends to further promote gum massage and/or improve cleaning in small gaps. The cross-section is typically round, oval or polygonal, such as triangular or rectangular. There can be an enlarged tuft of bristles at the tip of the brush. This tip tuft can be three to four times the size of other tufts, having a cross-sectional are in the range from about 5 to about 20, preferably from about 7 to about 12 $mm^2$. Such tip tufts typically project further outwardly than the other bristle tufts with the express purpose of penetrating behind rear molars. This can be achieved by providing the tip tuft with longer bristles than other tufts. Preferably it is at least partly achieved by angling the tip of the head as described above. This enables the bristles of the tip tuft to be kept shorter and hence firmer than would otherwise be the case. The tip tuft may also be angled forwards, away from the remaining tufts at an angle of up to 10°, preferably at an angle of 5 to 10° to a perpendicular to the bristle-bearing face. The total number of tufts is generally in the range from about 20 to about 50. The bristles typically have a length from about 5 to about 15 mm, preferably from about 8 to about 12 mm measured from the bristle-bearing face to the free ends of the bristles. The bristles can all be of the same length to provide an essentially flat brushing surface, or they can be cut to different lengths such that the free ends form a 3-D surface, for example a sinusoidal surface.

It is an essential feature of the present invention that the brush comprises at least two perimetric, elastomeric massaging elements alternately arranged with groups of bristle tufts along each of the longitudinal perimeter portions. Perimetric, elastomeric massaging elements are arranged along each of the longitudinal perimeter portions such that there are no other tufts or massaging elements which are more than 1 mm closer to the longitudinal edges of the brush head. It is these tufts that provide the important gum massaging benefits. The perimetric, elastomeric massaging elements are preferably made of a thermoplastic elastomer having a hardness from about 10 to about 60 Shore A, more preferably from about 20 to about 50 Shore A and most preferably about 40 Shore A. Suitable materials include those available under the tradenames Megol and Santoprene. Silicone elastomers are also useful.

The massaging elements have lengths which are in the same range as those described above for bristles. Also, like the bristle tufts, they generally have a uniform cross-section along their length. However, to assist in moulding they preferably taper towards their free ends along their entire length with an angle of taper typically in the range from about 1 to about 2°.

In order that the perimetric massaging elements have substantially similar bending moments in both longitudinal and transverse directions the perimetric massaging elements have rotational symmetry through an angle of 120° or less, more preferably 90° or less. By this is meant that when a perimetric massaging element is rotated about its long axis, after a rotation of 120° or less its cross-section will substantially overlay the original cross-section. Preferred cross-sectional shapes are selected from circular and regular polygonal, such as triangular, square or octagonal. Most preferably they are of circular cross-section. Elongated rectangular cross-sections will not meet the criterion of rotational symmetry since a rotation of 180° is necessary to reproduce the same shape. Such shapes, aligned to either the transverse or longitudinal axes have substantially different bending modes in the transverse and longitudinal directions. It will be appreciated however, that where the dimensions of a rectangle are closely similar, say within 20% or less, more so for 10% or less, much the same behaviour will be obtained as for a square shape. Preferably the free ends of the massaging elements are rounded, say for the final 1 to 2 mm of the element, of a diameter less than that of the main part of the element. The largest measurement (the thickness) of the perimetric massaging elements in cross-section is preferably from about 1 to about 3 mm, more preferably from about 1.5 to about 2.5 mm.

There are at least two, preferably at least three, more preferably at least four and optimally five perimetric massaging elements along each longitudinal perimeter portion of the brush head. In preferred embodiments single massaging elements alternate with single bristle tufts along the perimeter portions such that there is one bristle tuft between each pair of longitudinally adjacent perimetric massaging elements. The perimetric massaging elements can be grouped in pairs for example, though in such cases it is preferred that there be at least two sets along each edge of the brush with tufts in between each set.

In preferred embodiments the pattern of bristle tufts and massaging elements on the bristle-bearing face is symmetrical about the longitudinal axis of the head, so that perimetric massaging elements are arranged in pairs at either end of transverse axes of the head. Preferably also, in side view the tips of perimetric massaging elements and perimetric bristle tufts form an arc which has its highest point above the centre of the brush head and is lower at the handle and free ends of the head.

The brush can comprise massaging elements 20 (shown in FIG. 1) in addition to the perimetric massaging elements. These can be of similar size and shape to the perimetric massaging elements and can be located at the brush tip or in the central area of the brush located between the longitudinal perimeter portions, such as on the longitudinal axis of the head. Preferably however the number of such additional massaging elements is kept to four or less, preferably two or less. More preferably there are none so that the perimetric massaging elements are the only elastomeric massaging elements. In this way the 'rubbery' impression of the head is reduced. Suitably, the cross-sectional area proportion of all bristles and elastomeric massaging elements afforded by elastomeric massaging elements is less than 25%, preferably less than 15%. By "cross-sectional area proportion . . . afforded by elastomeric massaging elements" is meant the fraction of the sum of all cross sectional areas of bristle tufts and massaging elements that is represented by massaging elements alone. For example, if the cross-sectional areas of bristle tufts and massaging elements total 160 $mm^2$ and the cross-sectional areas of massaging elements alone total 20 $mm^2$ then the cross-sectional area proportion afforded by elastomeric massaging elements is 12.5%. For the avoidance of doubt, when considering bristle tufts, it is the total area of the tuft that is measured including any inter-bristle spaces within the tuft that arise from imperfect packing. All areas are measured at the bases of the tufts and massaging elements i.e. at the plane of the bristle-bearing face.

The perimetric massaging elements are preferably incorporated into the brush head by injection moulding. More preferably they are integrally moulded with elastomeric support elements which extend transversely across the back face of the toothbrush head. In the segmented brush heads referred to above these elastomeric support elements can be the connecting means between segments. Alternatively, and preferably, there can be a single elastomeric support element 80 (shown in FIG. 4A) which is an elastomeric sheet which covers substantially all of the back of the head. In such an embodiment there is preferably no elastomer covering the tip of the brush head.

BRIEF DESCRIPTION OF THE DRAWINGS

While the specification concludes with claims particularly pointing out and distinctly claiming the subject invention, it is believed the same will be better understood from the following description taken in conjunction with the accompanying drawings in which:

FIG. 4A is a side view showing another head of a toothbrush of the present invention.

FIG. 4B is a back view showing the head of FIG. 4A.

DETAILED DESCRIPTION OF THE DRAWINGS

Figure 1:
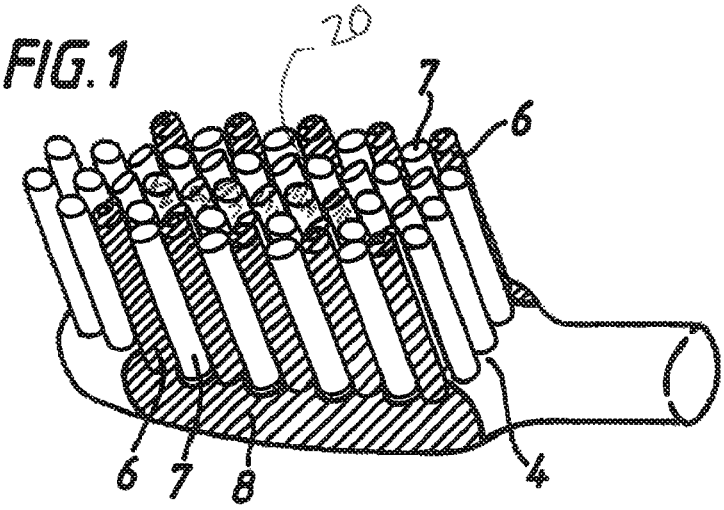
FIG. 1 is a perspective view of an embodiment of a toothbrush head of the present invention. For simplicity the handle is not shown in full. The massaging elements are shaded.
Figure 2:
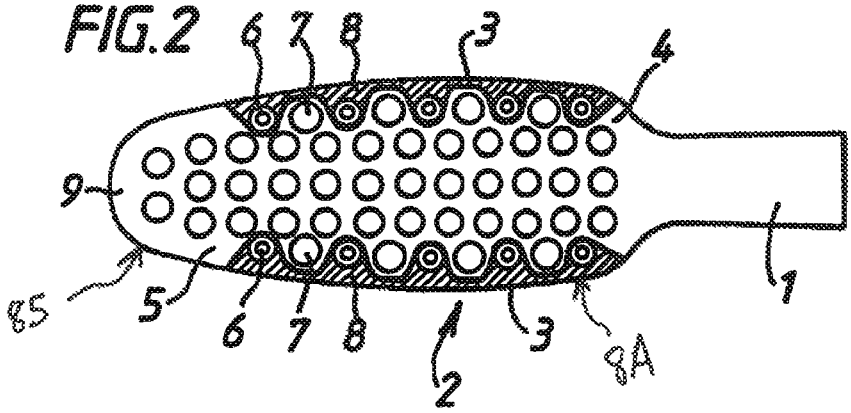
FIG. 2 is a plan view of the head of FIG. 1 showing the pattern of tufts and massaging elements. Massaging elements are shown with a small inner circle concentric with the element outline.
Figure 3:
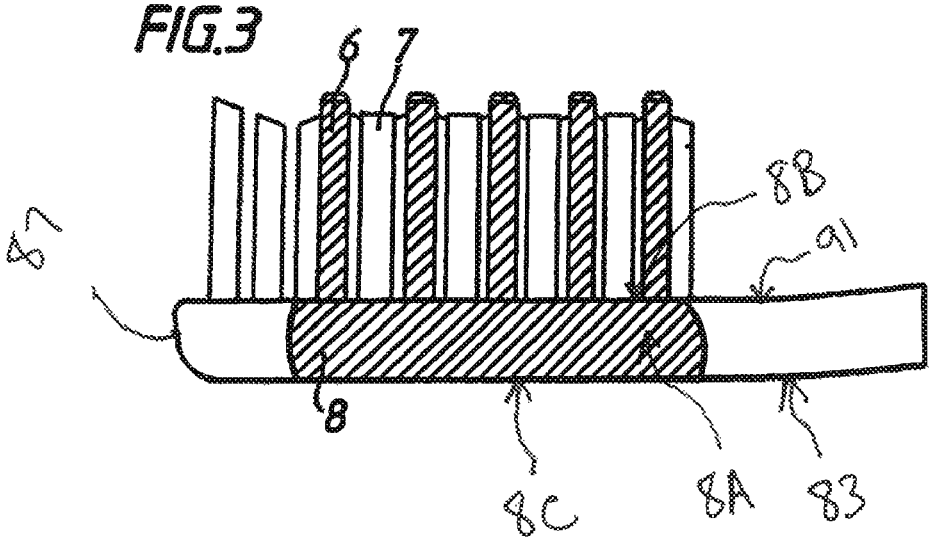
FIG. 3 is a side view of the head of FIG. 1.

Referring now to the drawings in detail wherein like numerals indicate the same element throughout the views there is shown in FIGS. 1, 2 and 3 an embodiment of the present invention which comprises outer longitudinal rows of perimetric massaging elements 6 and bristle tufts 7 extending upwardly from the bristle-bearing face 4 of head 2. The outer longitudinal rows are located on longitudinal perimeter portions 5 of the head. There is one bristle tuft 7 between each pair of adjacent perimetric massaging elements 6. The head is attached to handle 1, though the handle is not shown in full, it not being critical to the invention. The perimetric massaging elements 6 are integrally moulded with an elastomeric sheet 8 which wraps around the sides and back, but not the tip 87, of the head. The elastomeric sheet 8 includes side portions 8A, a front portion 8B, and a back portion 8C. As shown in FIG. 3, the elastomeric sheet 8 may be recessed in the head 2 such that the elastomeric sheet 8, e.g. the back portion 8C, is substantially flush with a back face 83 of the head 2. Similarly, the elastomeric sheet 8 may be recessed in the head 2 such that the elastomeric sheet 8, e.g. the front portion 8B, is substantially flush with a front face 91 of the head. As shown in FIG. 2, the elastomeric sheet 8 may be recessed in the head such that the elastomeric sheet 8, e.g. the side portions 8A, are flush with a side surface 85 of the head 2. The entire head 2 is moulded via a first step in which a skeleton is formed from polypropylene, simultaneously embedding bristle tufts 7, the elastomer of the massaging elements and support sheet being bonded to the skeleton in a second injection moulding step. Finally The perimetric massaging elements are circular in cross-section but taper very slightly towards their free ends. The longitudinal edges 3 of the polypropylene skeleton of the head are indented to provide points of anchorage for the elastomer. This can best be understood from the plan view of FIG. 2. When the elastomer has been moulded on, the longitudinal edges have a smooth curve.

In this embodiment the tip 9 of the brush is coplanar with the rest of the head. In more preferred embodiments however the tip is angled upwards as described further above.

What is claimed is:

1. A toothbrush head having a proximal end and a distal end furthest from the proximal end, the toothbrush head comprising:

a top face, a back face opposed to the top face, and a tip;

a plurality of bristle tufts attached to the head;

an elastomeric member covering a portion of the head, wherein the elastomeric member is recessed in the head such that the elastomeric member is substantially flush with the back face; and a first plurality of elastomeric elements integrally formed with the elastomeric member, each of the first plurality of elastomeric elements extending individually from the elastomeric member and terminating in a free end; and a second plurality of elastomeric elements disposed in a central area of the head.

2. The toothbrush head according to claim 1, wherein the elastomeric support element covers substantially all of the back face of the head.

3. The toothbrush head according to claim 1, wherein each of the first plurality of elastomeric elements taper toward their respective free end.

4. The toothbrush head of claim 1, wherein each of the first plurality of elastomeric elements has a round cross section.

5. The toothbrush head of claim 1, wherein the plurality of bristle tufts are attached to the head anchorlessly.

6. The toothbrush head of claim 1, wherein the first plurality of elastomeric elements are elongate from the top face.

7. The toothbrush head of claim 1, wherein the second plurality of elastomeric elements are elongate from the top face.

8. The toothbrush head of claim 1, wherein the second plurality of elastomeric elements are injection molded to the head.

9. The toothbrush head of claim 1, wherein the first plurality of elastomeric elements and/or the second plurality of elastomeric elements taper toward their free end by an angle of about 1 degree to about 2 degrees.

10. The toothbrush head of claim 1, wherein the first plurality of elastomeric elements are arranged adjacent sides of the head.

11. A toothbrush having handle and a head, the head having a proximal end and a distal end furthest from the proximal end, the head further comprising:

a first segment comprising a plurality of bristle tufts;

a second segment comprising a plurality of bristle tufts;

a third segment comprising a plurality of bristle tufts;

a first elastomeric connection between the first segment and the second segment, and a second elastomeric connection between the second segment and the third segment, wherein the first elastomeric connection and the second elastomeric connection allow the second segment to move with respect to the first segment and the third segment;

an elastomeric member covering at least a portion of a back face; and a first plurality of elastomeric elements integrally formed with the elastomeric member, each of the first plurality of elastomeric elements extending individually from the elastomeric member and terminating in a free end.

12. The toothbrush head according to claim 11, wherein the elastomeric member covers substantially all of the back face of the head.

13. The toothbrush head according to claim 11, further comprising a second plurality of elastomeric elements disposed in a central area of the head.

14. The toothbrush head according to claim 11, wherein each of the first plurality of elastomeric elements taper toward their respective free end.

15. The toothbrush head according to claim 11, wherein the elastomeric member is flush with the back face of the head.

16. The toothbrush head of claim 11, wherein each of the first plurality of elastomeric elements has a round cross section.

17. The toothbrush of claim 11, wherein the first elastomeric connection comprises an elastomeric material only.

18. The toothbrush of claim 17, wherein the second elastomeric connection comprises an elastomeric material only.

19. The toothbrush of claim 11, wherein at least one of the first elastomeric connection or the second elastomeric connection comprises an elastomer and a plastic link integrally formed with one of the first segment, the second segment, or the third segment.

20. A toothbrush having handle and a head, the head comprising:

a first segment comprising a plurality of bristle tufts;

a second segment comprising a plurality of bristle tufts, the second segment being longitudinally spaced from the first segment;

a first flexible connection between the first segment and the second segment, the first flexible connection allowing the second segment to move relative to the first segment;

a third segment comprising a plurality of bristle tufts, the third segment being longitudinally spaced from the second segment;

a second flexible connection between the second segment and the third segment, the second flexible connection allowing the second segment to move relative to the third segment, at least one of the first flexible segment or the second flexible segment comprising an elastomer and a plastic link integrally formed with the first segment, the second segment, or the third segment;

an elastomeric member covering at least a portion of a back face and being recessed in the head such that the elastomeric member and the back face are substantially flush; and a first plurality of elastomeric elements integrally formed with the elastomeric member, each of the first plurality of elastomeric elements extending individually from the elastomeric member and terminating in a free end.

21. A toothbrush having a handle, a head, and a neck disposed between the handle and the head, the head comprising:

a first support having a top face a back face opposed to the top face, and a first plurality of contact elements, the first support comprising a first material;

a second support recessed in the first support such that the second support is substantially flush with the back face, the second support comprising a second material which is different from the first material;

a second plurality of contact elements integrally formed with the second support element, each of the second plurality of contact elements extending individually from the second support element and terminating in a free end, and wherein the first plurality of contact elements and the second plurality of contact elements are different; and a plurality of elastomeric elements attached to the head, the plurality of elastomeric elements being disposed in a central region of the head.

22. The toothbrush of claim 21, wherein the first support comprises polypropylene.

23. The toothbrush of claim 22, wherein the second support comprises an elastomer.

24. The toothbrush of claim 23, wherein the first plurality of contact elements comprises bristle tufts.

25. The toothbrush of claim 24, wherein the second plurality of contact elements comprise an elastomer.

* * * * *